US008750534B2

(12) United States Patent
Yamkovoy et al.

(10) Patent No.: US 8,750,534 B2
(45) **Date of Patent: *Jun. 10, 2014**

(54) COMMUNICATIONS HEADSET POWER PROVISION

(75) Inventors: Paul G. Yamkovoy, Acton, MA (US); Benjamin D. Burge, Shaker Heights, OH (US)

(73) Assignee: Bose Corporation, Framingham, MA (US)

( * ) Notice: Subject to any disclaimer, the term of this patent is extended or adjusted under 35 U.S.C. 154(b) by 348 days.

This patent is subject to a terminal disclaimer.

(21) Appl. No.: 13/152,455

(22) Filed: Jun. 3, 2011

(65) Prior Publication Data

US 2012/0308048 A1 Dec. 6, 2012

(51) Int. Cl.
*H04R 1/10* (2006.01)
*H04R 3/00* (2006.01)

(52) U.S. Cl.
USPC ..... 381/74; 381/111

(58) Field of Classification Search
USPC ..... 381/119, 122, 107, 111, 92, 118, 74, 381/91, 104, 109, 113, 120, 190, 191, 66, 1, 381/115, 123, 151, 152, 174, 2, 26, 306, 381/315, 328, 364, 370, 384, 58, 59, 64, 77, 381/79, 83, 94.1, 94.5, 95; 84/742; 379/430; 307/89–91
See application file for complete search history.

(56) References Cited

U.S. PATENT DOCUMENTS

| | | | | |
|---|---|---|---|---|
| 2004/0136522 | A1 | 7/2004 | Wurtz | |
| 2006/0013410 | A1 | 1/2006 | Wurtz | |
| 2007/0025561 | A1 | 2/2007 | Gauger et al. | |
| 2010/0254542 | A1 * | 10/2010 | Schunack et al. | 381/74 |
| 2011/0013780 | A1 * | 1/2011 | Yamkovoy | 381/58 |

FOREIGN PATENT DOCUMENTS

DE 202009004276 U1 7/2009

OTHER PUBLICATIONS

Aeroelectric, "Aircraft Microphone Jack Wiring", 2007, p. 2.*
International Search Report and Written Opinion for International Application No. PCT/US2012/04035, dated Aug. 9, 2012.

* cited by examiner

*Primary Examiner* — Vivian Chin
*Assistant Examiner* — William A Jerez Lora

(57) ABSTRACT

Electric power is provided to a two-way communications headset by creating a differential DC voltage potential between a ground conductor associated with a microphone of that headset and a ground conductor associated with an acoustic driver of that headset, thereby enabling that headset to refrain from drawing electric power from a more limited local power source.

14 Claims, 9 Drawing Sheets

5000

5000

1000b
to upper assembly 100
VCC
microphone router 540
wireless transceiver 580
audio circuit 550
auxiliary interface 590
audio router 560
control box 270b
injected voltage tap 245
power multiplexer 260
local power source 265
300b
375b
interface 390b
alt-mic-high
alt-mic-low
aircraft-VCC
system-gnd
audio-right
audio-left
"Lemo"
395
1
6
or
"U-174"

COMMUNICATIONS HEADSET POWER PROVISION

TECHNICAL FIELD

This disclosure relates to providing electric power to a two-way communications headset coupled to an aircraft ICS through interfaces not originally meant to support conveying electric power.

BACKGROUND

In recent years, aviation headsets have expanded in functionality from being two-way communications headsets meant only for use with an aviation intercom system (ICS) to additionally including the ability to accept (wirelessly or via conductive cabling) audio from an auxiliary audio source to (e.g., a tape recorder playing music, solid-state music playing device, etc.), to provide active noise reduction functionality (ANR), and to wirelessly link with cell phones for two-way communications with that cell phone. However, the addition of these newer functions to an aviation headset imposes a requirement that electric power be provided to that headset.

Unfortunately, predominant aviation headset interface standards employed in coupling a headset to an ICS in many forms of aircraft were never meant to supply a headset with electric power. The "general aviation" (GA) interface, which is the most widely used form of aviation headset interface standard in civilian airplanes, employs a pair of connectors that enable the connection of two microphone conductors and a push-to-talk (PTT) control conductor through one of the connectors, and the connection of left and right audio channel conductors and an associated ground conductor through the other of the connectors. Correspondingly, the most widely used form of aviation headset interface standard in helicopters employs a single connector, the "U-174" connector, that enables the connection of two microphone conductors and only a monaural audio channel conductor and associated ground conductor. These interface standards were created at a time in which carbon microphones requiring a relatively high 8-16V microphone bias voltage were used, and provision of this relatively high bias voltage continues to the present day despite the vast majority of currently used headsets incorporating either an electret microphone needing only a much smaller bias voltage or a dynamic microphone needing none. Unfortunately, this relatively high bias voltage is typically provided with relatively small current capacity, making it unsuited for use in powering such newer functionality due to the likelihood of generating distortion in the signal output by the microphone.

An alternative aviation headset interface employing a single six-pin connector that replaces the PTT conductor with a power conductor to convey 8-32V with greater current capacity to a headset has been introduced in recent years, commonly referred to as a "Lemo" interface in reference to the original manufacturer of the six-pin connector it uses, i.e., LEMO® of Switzerland. Unfortunately, despite the introduction of the "Lemo" interface, the GA and U-174. interfaces remain the predominant ones used in civilian airplanes and in helicopters, respectively. As a result, aviation headsets must frequently support carrying relatively large capacity batteries to support the newer functionality, resulting in an undesirably bulky and heavy control box positioned along a cable of a headset to hold those batteries, which must be replaced from time to time.

SUMMARY

Electric power is provided to a two-way communications headset by creating a differential DC voltage potential between a ground conductor associated with a microphone of that headset and a ground conductor associated with an acoustic driver of that headset, thereby enabling that headset to refrain from drawing electric power from a more limited local power source.

In one aspect, a method of providing electric power to a headset includes creating a DC voltage differential between a ground conductor of a microphone of the headset and a ground conductor of an acoustic driver of the headset; or includes creating a DC voltage differential between a microphone ground conductor to be coupled to a headset interface of an aircraft communications system and an acoustic driver ground conductor to be coupled to the headset interface of the aircraft communications system. In another aspect, an apparatus to power a headset includes a headset interface with at least one connector to receive at least one connector of the headset; a microphone ground conductor coupled to the interface to conduct a signal of a microphone of the headset; an acoustic driver ground conductor coupled to the interface to conduct a signal of at least one acoustic driver of the headset; and a voltage source coupled to the microphone ground conductor to create a DC voltage differential between the microphone and acoustic driver ground conductors.

In one aspect method of providing electric power to a headset includes receiving electric power from a DC voltage differential between a ground conductor of a microphone of the headset and a ground conductor of an acoustic driver of the headset. In another aspect, a headset includes a headset interface by which the headset may be coupled to another headset interface of an ICS; an acoustic driver to acoustically output audio to an ear of a user; an acoustic driver ground conductor coupling the acoustic driver to the headset interface; a microphone to detect speech sounds of the user; a microphone ground conductor coupling the microphone to the headset interface; and an injected voltage tap circuit coupled to the acoustic driver ground conductor and to the microphone ground conductor to receive electric power provided to the headset through the headset interface by creating a DC voltage differential between the acoustic driver ground and the microphone ground.

DETAILED DESCRIPTION

What is disclosed and what is claimed herein is intended to be applicable to a wide variety of headsets, i.e., devices structured to be worn on or about a user's head in a manner in which at least one acoustic driver is positioned in the vicinity of an ear, and in which a microphone is positioned in the vicinity of the user's mouth to enable two-way audio communications. It should be noted that although specific embodiments of headsets incorporating a pair of acoustic drivers (one for each of a user's ears) are presented with some degree of detail, such presentations of specific embodiments are intended to facilitate understanding through examples, and should not be taken as limiting either the scope of disclosure or the scope of claim coverage.

It is intended that what is disclosed and what is claimed herein is applicable to headsets that also provide active noise reduction (ANR), passive noise reduction (PNR), or a combination of both. It is intended that what is disclosed and what is claimed herein is applicable to headsets structured to be connected with at least an intercom system through a wired connection, but which may be further structured to be connected to any number of additional devices through wired and/or wireless connections. It is intended that what is disclosed and what is claimed herein is applicable to headsets having physical configurations structured to be worn in the vicinity of either one or both ears of a user, including and not limited to, over-the-head headsets with either one or two earpieces, behind-the-neck headsets, two-piece headsets incorporating at least one earpiece and a physically separate microphone worn on or about the neck, as well as hats or helmets incorporating earpieces and a microphone to enable audio communication. Still other embodiments of headsets to which what is disclosed and what is claimed herein is applicable will be apparent to those skilled in the art.

Figure 1:
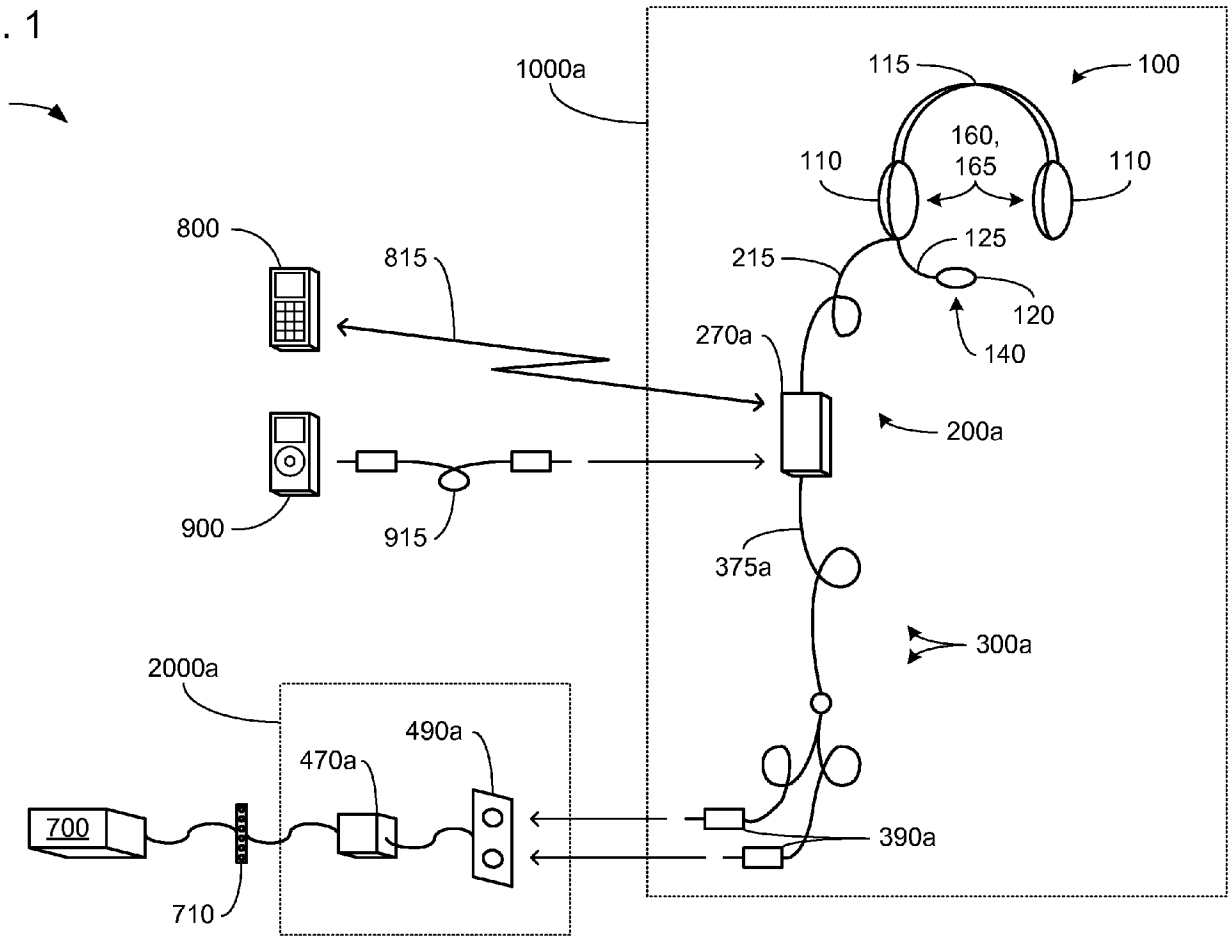
FIG. 1 is a perspective diagram of a communications system including embodiments of a power injector added to an ICS and a headset able to use the power provided by the power injector.

FIG. 1 depicts an embodiment of a communications system 5000 including both a headset 1000*a*. and a power injector assembly 2000*a*. interposed between the headset 1000*a*. and a terminal block 710 by which a headset may be coupled to an intercom system (ICS) 700. As will be familiar to those skilled in the art of civilian aircraft communications systems, an ICS and at least one interface (in the form of one or a pair of connectors typically mounted on a plate) to enable a headset to be coupled to that ICS in a civilian aircraft is typically installed by a technician in a manner that is customized for the owner of that aircraft after that aircraft has been purchased. Therefore, to facilitate such customized installations, it is common practice to provide a terminal block (e.g., the terminal block 710) within an aircraft to which wire leads from the chosen ICS and wire leads from the chosen headset interface (s) may be electrically coupled in an organized manner that facilitates future repair.

However, unlike typical installations of communications systems in which the wire leads of a headset interface would be directly coupled to appropriate screw terminal points on the terminal block 710, in the communications system 5000, the wire leads from a headset interface 490*a*. are coupled to a power injector 470*a*. (the two of which, together, make up the power injector assembly 2000*a*), which is in turn coupled by wire leads to the terminal block 710 in place of wire leads of the headset interface 490*a*. As will be explained in greater detail, the power injector 470*a*. overcomes the lack of a distinct power pin on either of the two connectors making up the headset interface 490*a*. by shifting a voltage level of at least one of the conductors conveying a signal along a cable of a headset relative to a voltage of another of those conductors to provide electric power to that headset.

The headset 1000*a*. incorporates an upper assembly 100, a mid assembly 200*a*. and a lower assembly 300*a*. The upper assembly 100 incorporates a pair of earpieces 110 that each incorporate one of a pair of acoustic drivers 160 and 165, a headband 115 that couples together the earpieces 110, and a microphone boom 125 extending from one of the earpieces 110 to support a microphone casing 120 incorporating a microphone 140. The headset 1000*a*. has an "over-the-head" physical configuration commonly found among aviation headsets. Depending on the size of each of the earpieces 110 relative to the typical size of the pinna of a human ear, each of the earpieces 110 may be either an "on-ear" (also commonly called "supra-aural") or an "around-ear" (also commonly called "circum-aural") form of earcup. However, despite the depiction in FIG. 1 of this particular physical configuration of the head assembly 100, those skilled in the art will readily recognize that the head assembly may take any of a variety of other physical configurations. The mid assembly 200*a* incorporates a control box 270*a*. and an electrically conductive cable 215 that couples the control box 270*a*. with multiple electrical conductors to one of the earpieces 110, from which further conductors may extend through the headband 115 to electrically couple together the two earpieces 110. The lower assembly 300*a*. incorporates a headset interface 390*a*. made up of a pair of connectors, and a conductive cable 375*a*. that is split at some point along its length (or possibly split at the control box 270*a*) to be coupled to each of the two connectors making up the headset interface 390*a*.

As also depicted in FIG. 1, various variations of the headset 1000*a*. are capable of performing various other functions beyond simply enabling a user of the headset 1000*a*. to interact with the ICS 700. The headset 1000*a*. may incorporate a wireless transceiver enabling the headset 1000*a*. to be coupled via wireless signals 815 (e.g., infrared signals, radio frequency signals, etc.) to a wireless device 800 (e.g., a cellphone, an audio recording and/or playback device, a two-way radio, etc.) to thereby enable a user of the headset 1000*a*. to additionally interact with the wifeless device 800 through the headset 1000. Alternatively or additionally, the headset 1000*a*. may incorporate an auxiliary interface (e.g., some form of connector to at least receive analog or digital signals representing audio) enabling the headset 1000*a*. to be coupled through a cable 915 to a wired device 900 (e.g., an audio playback device, an entertainment radio, etc.) to enable a user to at least listen through the headset 1000*a*. to audio provided by the wired device 900. Although not specifically depicted in FIG. 1, in various possible embodiments, the control box 270*a*. may provide one or more manually-operable controls to enable the user to control one or more aspects of the operation of the headset 1000*a*, possibly including coordinating the transfer of audio among the headset 1000*a*, the ICS 700, the wireless device 800 and the wired device 900. Further, and although also not depicted in FIG. 1, at least some of the circuitry carried within the control box 270*a*. (and accordingly, at least some of the functionality of the control box 270*a*) may be incorporated into one or both of the earpieces 110 (or some other portion of the upper assembly 100), thereby possibly obviating the need for the mid assembly 200*a*. to incorporate the control box 270*a*. (and perhaps permitting the entirety of the mid assembly to be eliminated such that the upper assembly 100 is directly coupled to the lower assembly 300*a*).

The connectors of the headset interfaces 390*a*. and 490*a*. are preferably chosen to at least physically conform to the GA interface standard, and cooperate to allow the headset 1000*a*. to be detachably coupled to the ICS 700 through the power injector 470*a*. and the terminal block 710. It is because the GA interface standard entails using pairs of connectors that each of the interfaces 390*a* and 490*a*. incorporate a pair of connectors, as has been described. Thus, although the interfaces 390*a* and interface 490*a*. have been described as being part of the same communications system 5000, the adherence of the interface 390*a*. to the GA interface standard enables the headset 1000*a*. to be coupled to a GA-compliant interface of another ICS of another aircraft, and the adherence of the interface 490*a*. to the GA interface standard enables another headset having a GA-compliant interface to be coupled to the ICS 700 through the power injector assembly 2000*a*.

Figure 2A:
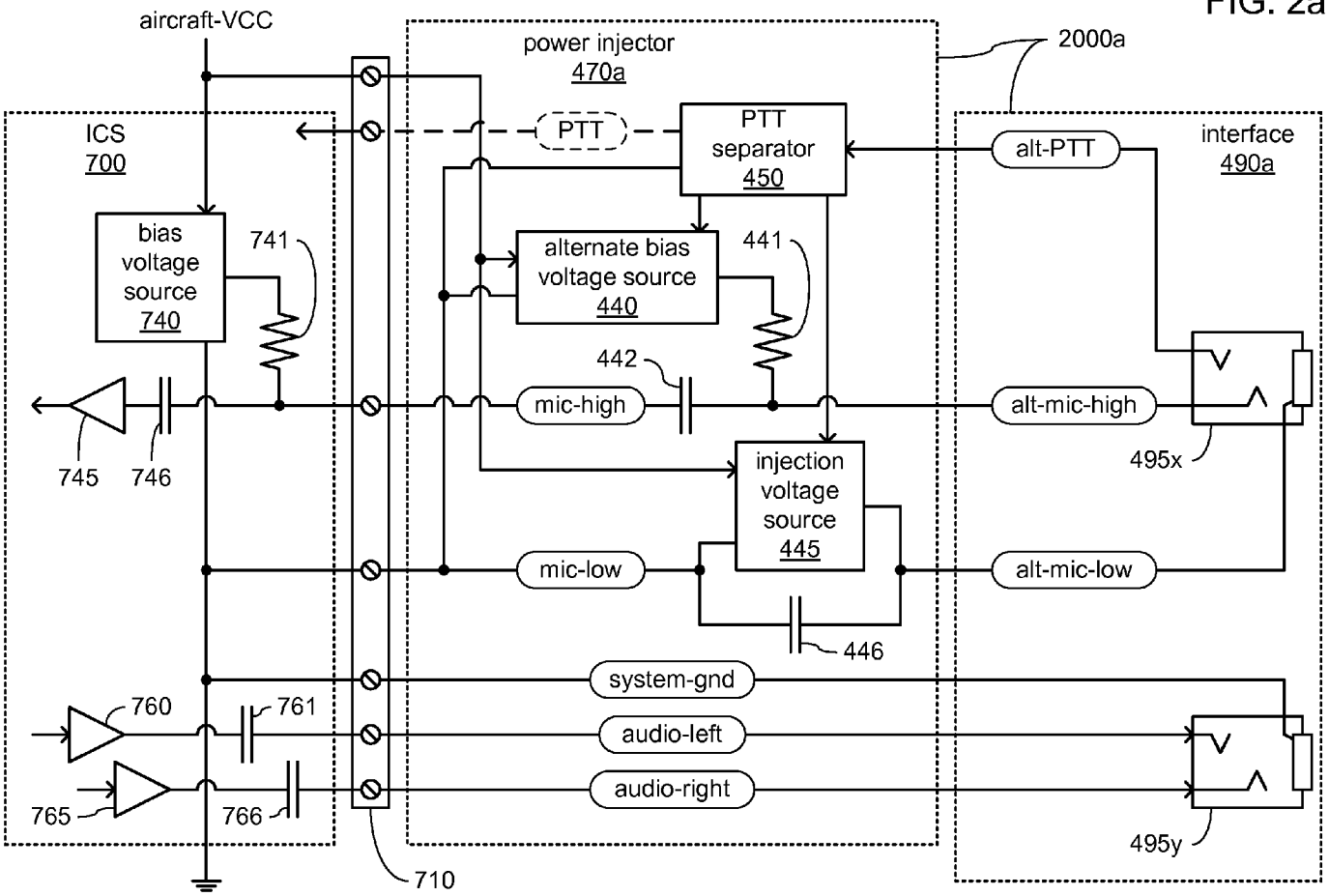
FIGS. 2*a*. and 2*b*, together, form a block diagram of a possible electrical architecture of the communications system of FIG. 1, FIG. 2*a*. depicting a possible electrical architecture of the power injector and FIG. 2*b*. depicting a possible electrical architecture of the headset.

FIGS. 2*a*. and 2*b*, together, depict a possible embodiment of an electrical architecture that may be employed by the power injector assembly 2000*a*. and the headset 1000*a*. Interconnections among the ICS 700, the terminal block 710, the power injection assembly 2000*a*. and the headset 1000*a*. are depicted in a somewhat schematic-like block diagram to facilitate understanding.

Turning to FIG. 2*a*, the ICS 700 may be any of a wide variety of commercially available intercom systems well known to those skilled in aircraft communications systems. Thus, only a portion of the electrical architecture of the ICS 700 pertinent to discussing the operation of the power injection assembly 2000*a*. and the headset 1000*a*. is presented for sake of visual clarity. Thus as depicted to facilitate discussion, the ICS 700 incorporates at least a bias voltage source 740; a resistor 741; a microphone amplifier 745; audio amplifiers 760 and 765; and capacitors 746, 761 and 766.

The ICS 700 is coupled to both a ground and an aircraft-VCC of whatever aircraft into which the ICS 700 is installed. The ICS 700 is also coupled to the terminal block 710 via multiple wire leads conveying a push-to-talk (PTT) conductor; both high and low microphone (mic-high and mic-low) conductors; a system ground (system-gnd) conductor; and at least one of left and right audio channel (audio-left and audio-right) conductors. Within the ICS 700, the mic-low and system-gnd conductors are typically both coupled directly to the ground of the aircraft to which the ICS 700 is, itself, coupled. In this way, the mic-low and system-gnd conductors effectively become the ground conductors for a microphone and at least one acoustic driver, respectively. The audio-left and audio-right conductors are driven with left and right audio signals by the audio amplifiers 760 and 765 through the capacitors 761 and 766, respectively. The bias voltage source 740 is coupled to both the aircraft-VCC and ground of the aircraft to generate a microphone bias voltage that is driven onto the mic-high conductor through the resistor 741. The resistor 741 usually has a resistance in the range of 220-470. ohms, and the bias voltage source 740 is usually a voltage regulator configured to output a microphone bias voltage of 8-16VDC onto the mic-high conductor. The mic-high conductor is also coupled to the microphone amplifier 745 through a capacitor 746, the capacitor 746 serving as an AC coupling to decouple the input of the microphone amplifier 745 from the microphone bias voltage while passing through analog signals representing speech sounds detected by a microphone. The PTT conductor is coupled to circuitry (not shown) within the ICS 700 that responds to the use of a PTT switch (not shown) operable to selectively couple the PTT and mic-low conductors in a manner that will be well known to those skilled in the art of aircraft communications systems.

As has been depicted and discussed, it is envisioned that the power injector 470*a*. and the interface 490*a*. are physically separate components coupled via wire leads. The interface 490*a*. may be provided by whatever technician installs the communications system 5000 in an aircraft from a vendor or other source that is different from that of the power injector 470*a*, however, it is envisioned that the power injector 470*a*. and the interface 490*a*. would be provided together as components of a single installation kit (i.e., these components of the power injector assembly 2000*a*. would be provided together as an installation kit). Thus, although depicted as separate, it should be noted that embodiments of the power injector assembly 2000*a*. are possible in which power injector 470*a*. and the interface 490*a*. are combined as a single one-piece unit.

The power injector 470*a*. incorporates an alternate bias voltage source 440, a resistor 441, an injection voltage source 445, a PTT separator 450, and capacitors 442 and 446. The interface 490*a* incorporates connectors 495*x*. and 495*y*. Through being coupled to the terminal block 710 by wire leads, the power injector 470*a*. is coupled to the mic-high, mic-low, system-gnd, audio-left and audio-right conductors, as well as perhaps also the PTT conductor. Also through being coupled to the terminal block 710 by still another wire lead, the power injector 470*a*. is coupled to the aircraft-VCC. Within the power injector 470*a*, the system-gnd, audio-left and audio-right conductors are conveyed, preferably directly as depicted, onward to the interface 490*a*. via the wire leads that couple together the power injector 470*a*. and the interface 490*a*. The mic-low conductor is coupled to an alternate microphone low (alt-mic-low) conductor through both the injection voltage source 445 and the capacitor 446, and the mic-high conductor is coupled to an alternate microphone high (alt-mic-high) conductor through the capacitor 442. Where the power injector 470*a*. is coupled to the PTT conductor, within the power injector 470*a*, the PTT conductor is coupled to the PTT separator 450 which is also coupled to an alternate PTT (alt-PTT) conductor. The alt-PTT, alt-mic-high and alt-mic-low conductors are conveyed onward to the interface 490*a*. in lieu of the PTT, mic-high and mic-low conductors, respectively. Both the alternate bias voltage source 440 and the injection voltage source 445 are also coupled to the aircraft-VCC; and at least the alternate bias voltage source 440 is coupled to the mic-low conductor, as well as possibly also the PTT separator 450.

The injection voltage source 445 employs the aircraft-VCC (relative to the mic-low conductor) to generate a difference in voltage potential between the mic-low and alt-mic-low conductors. Given that the mic-low and system-gnd conductors are typically coupled together within aircraft intercom systems (such as depicted within the ICS 700), this generation of a voltage potential between the mic-low and alt-mic-low conductors also creates a voltage potential between the system-gnd and alt-mic-low conductors. As will be explained in greater detail, this effectively "injects" electric power into at least one of the conductors that ultimately reaches the headset 1000*a*. by which circuits involved in providing various features within the headset 1000*a*. may be provided with electric power by effectively "shifting" the voltage level of at least the alt-mic-low conductor relative to the mic-low and system-gnd conductors. In effect, the injection voltage source 445 behaves as a DC voltage source placed across the mic-low and alt-mic-low conductors. It is preferred that the voltage potential of about 3VDC be provided in this manner with the alt-mic-low conductor being "shifted" to be at a voltage level that is 3V above the voltage level of the mic-low conductor.

The coupling of the capacitor 446 to the mic-low and alt-mic-low conductors in parallel with the injection voltage source 445 is meant to ensure that analog signals representing speech sounds detected by a microphone are able to propagate from the alt-mic-low conductor to the mic-low conductor with relatively little resistance. Although a DC voltage source (such as what is provided by the injection voltage source 445 between the mic-low and alt-mic-low conductors) normally appears as short or a resistor imposing relatively little resistance at lower frequencies, a voltage source can start to impose greater resistances at higher frequencies, possibly including frequencies at which speech sounds occur. The capacitor 446 overcomes this while still decoupling the difference in DC voltage potential between the mic-low and alt-mic-low conductors.

The alternate bias voltage source 440 employs the aircraft-VCC (relative to the mic-low conductor) to generate an alternative microphone bias voltage that is to be provided to the headset 1000*a*. in place of the microphone bias voltage output by the bias voltage source 740 of the ICS 700. The alternate bias voltage source 440 drives this alternate microphone bias voltage onto the alt-mic-high conductor through the resistor 441 in a manner analogous to that in which the bias voltage source 740 drives its microphone bias voltage onto the mic-high conductor through the resistor 741. Thus, it is preferred that the resistor 441, like the resistor 741, has a resistance in the range of 220-470. ohms. This alternate microphone bias voltage driven onto the alt-mic-high conductor is selected to be akin to the microphone bias voltage driven onto the mic-high conductor, but shifted by an amount of voltage similar to that by which the alt-mic-low conductor is shifted relative to the mic-low conductor by the injection voltage source 445. By shifting the voltage driven onto the alt-mic-high conductor relative to the mic-high conductor by a similar voltage as that by which the alt-mic-low conductor is shifted relative to the mic-low conductor, it is intended that the voltage potential between the alt-mic-high and alt-mic-low conductors will be similar to the voltage potential between the mic-high and mic-low conductors.

Thus, it is preferred that the alt-mic-high conductor be driven by an alternate microphone bias voltage that is 3V above the microphone bias voltage driven onto the mic-high conductor. As depicted, the alternate bias voltage source 440 is not coupled to the mic-high conductor, and therefore, is unable to detected the microphone bias voltage driven onto the mic-high conductor for purposes of providing a reference for determining what alternate microphone bias voltage should be driven onto the alt-mic-high conductor. Given that any voltage in the range of 8-16VDC (relative to the mic-low conductor) may be driven onto the mic-high conductor by the bias voltage source 740, it may be that an average microphone bias voltage or other estimation of what microphone bias voltage is most frequently encountered among a range of aircraft intercom systems may be derived, with 3V added to that derived voltage to define what the alternate microphone bias voltage should be. Alternatively, the alternate bias voltage source 440 may be additionally coupled to the mic-high conductor to employ the microphone bias voltage driven thereon by the bias voltage source 740 as a reference for deriving what the alternate microphone bias voltage should be.

The PTT separator 450 monitors the level of resistance between the alt-PTT and alt-mic-low conductors to distinguish at least among the presence of a very high resistance consistent with their being no coupling between these two conductors, the presence of a very low resistance consistent with these two conductors being directly coupled, and the presence of a triggering resistance that is detectably between the very low and very high resistances. As will be explained in greater detail, the triggering resistance is provided by the headset 1000*a*. to provide an indication that the headset 1000*a*, which is capable of making use of the electric power provided by shifting at least the voltage level of the alt-mic-low conductor relative to the system-gnd conductor, is coupled to the power injector assembly 2000*a*, and not a different headset that is not capable of making use of such a provision of electric power. More precisely, the PTT separator 450 is coupled to both the alternate bias voltage source 440 and the injection voltage source 445, and signals both to either provide shifted voltage levels or not (i.e., provides both with an "enable" signal or not, respectively), depending on the level of resistance detected between the alt-PTT and alt-mic-low conductors. Thus, where the triggering resistance is detected, the PTT separator 450 signals the injection voltage source 445 to shift the voltage potential of the alt-mic-low conductor relative to the mic-low conductor and signals the alternate bias voltage source 440 to provide an alternate microphone bias voltage that is shifted in a similar manner, and where the triggering resistance is not detected, the PTT separator 450 signals the injection voltage source 445 to cease shifting the voltage potential of the alt-mic-low conductor relative to the mic-low conductor such that both are at the same voltage level, and signals the alternate bias voltage source 440 to provide an alternate microphone bias voltage that is not shifted.

The provision of the PTT separator 450 to control the injection voltage source 445 and the alternate bias voltage source 440, instead of simply allowing both to always function to shift the voltages of both of the alt-mic-low and alt-mic-high conductors may be deemed desirable as a feature to accommodate the possible use of improperly designed headsets with the ICS 700 through the interface 490*a*. It is a widespread and highly-regarded practice to never couple together the mic-low and system-gnd conductors within a headset, despite the fact that they are usually coupled within typical aircraft intercom systems, in order to avoid the creation of a ground loop through what are often very lengthy runs of cabling between a headset and its connection to an aircraft ICS. Thus, by not enabling at least the injection voltage source 445, instances of an improperly designed headset being coupled to the interface 490*a*. will not result in a shorting of the output of the injection voltage source 445 to ground.

As those familiar with aircraft intercom systems will readily recognize, PTT switches are usually implemented with spring-biased, normally open, pushbutton-type switches that are meant to be operated by a user against the spring bias to close in a manner coupling the PTT and mic-low conductors when the user chooses to talk through an aircraft intercom system. In earlier years, the PTT switch would be carried on some portion of the headset, such as in the vicinity of the microphone positioned on a boom in front of the user's mouth. However, in more recent years, it has become common practice to position a PTT switch on one of the steering controls (e.g., the yoke in a civilian airplane) or other location closer to the likely location of one of the user's hands so as to avoid requiring a user to reach up to a headset to operate it; and it has become common practice to couple such a PTT switch located closer to a user's hands to the mic-low and PTT conductors at the terminal block 710. Thus, although the PTT conductor on a GA-compliant interface has largely ceased to be used in more recent years, it is still almost always present on GA-compliant headset interfaces installed in aircraft to accommodate the ever decreasing number of headsets that still carry a PTT switch.

Where the PTT separator 450 is coupled to the PTT conductor to accommodate this continuing commonplace support of such headsets, the PTT separator 450 responds to instances of a very low resistance between the alt-PTT and alt-mic-high conductors by coupling the PTT conductor to the mic-low conductor in a manner mimicking the behavior of a PTT switch that is coupled directly to the PTT and mic-low conductors and that has been operated to close so as to couple those two conductors, and the PTT separator 450 responds to instances of there being no such very low resistance between the alt-PTT and alt-mic-low conductors by refraining from coupling the PTT conductor to the mic-low conductor. However, as hinted by the PTT conductor within the power injector 470*a*. being depicted with dashed lines, embodiments are possible in which support for the rare few headsets that still incorporate a PTT switch is not provided such that the PTT separator 450 is not coupled to the PTT conductor and/or such that the PTT separator 450 takes no action to in any way drive a voltage level onto the PTT conductor or to in any way coupled the PTT conductor to the mic-low conductor, regardless of what occurs on the alt-PTT conductor.

Further, and especially in embodiments in which the PTT separator 450 is coupled to the PTT conductor to accommodate a headset incorporating a PTT switch, the PTT separator 450 may have a latching characteristic in which the PTT separator 450 maintains its enable signal to the alternate bias voltage source 440 and the injection voltage source 445 in spite of detecting the triggering resistance being replaced with a resistance consistent with the alt-PTT and alt-mic-low conductors being coupled. More precisely, in such embodiments, where the PTT separator 450 detects a triggering resistance between the alt-PTT and alt-mic-low followed by the resistance between these two conductors changing to a very low resistance consistent with these two conductors being coupled, the PTT separator 450 continues to provide an enable signal to the injection voltage source 445 and the alternate bias voltage source 440 based on the assumption that this change to a very low resistance indicates a use of a PTT switch integrated into a variant of the headset 1000*a*. that incorporates a PTT switch (not shown). Indeed, the fact that a transition directly from a triggering resistance to such a very low resistance has occurred can be taken as a basis for assuming that the very same headset 1000*a*. is still coupled to the headset interface 490*a*, since an uncoupling should bring about a very high resistance consistent with no coupling between the alt-PTT and alt-mic-low conductors, whatsoever. Still more precisely, in such embodiments, detecting the onset of a triggering resistance may serve as a trigger for the PTT separator 450 to begin to output such an enable signal, while detecting the transition from there being a triggering resistance to their being a very high resistance may serve as a trigger for the PTT separator 450 to cease to output such an enable signal. Further, a transitions directly between a triggering resistance and a very low resistance may cause the PTT separator 450 to continue to output such an enable signal (in effect, detecting a very low resistance simply causes the PTT separator 450 to refrain from changing the state of its output between continuing or ceasing to output such an enable signal), while a transition from a very low resistance directly to a very high resistance may serve as a trigger for the PTT separator 450 to cease to output such an enable signal (in effect, detecting a very high resistance simply causes the PTT separator 450 to always cease outputting any such enable signal). Through such latching of the state of the enable signal output to the alternate bias voltage source 440 and the injection voltage source 445, situations in which operation of a PTT switch incorporated into an embodiment of the headset 1000*a*. causes transitions between a triggering resistance and a very low resistance will not cause the provision of electric power to that embodiment of the headset 1000*a*. by the power injection 470*a*. to be interrupted every time that PTT switch is operated.

As previously discussed, the connectors 495*x*. and 495*y*. are selected to enable implementation of a GA-compliant headset interface, and therefore, preferably, the connector 495*x*. is a receptacle configured to receive a 0.206" TRS-type plug and the connector 495*y*. is a receptacle configured to receive a 0.250" TRS-type plug, in keeping with the GA interface standard. Within the interface 490*a*, the alt-PTT, alt-mic-high and alt-mic-low conductors are coupled to the connector 495*x*. in a manner in which the PTT, mic-high and mic-low conductors would normally be coupled in accordance with the GA interface standard in a more conventional aircraft communications system in which the power injector 470*a*. was not interposed between the terminal block 710 and the interface 490*a*. Thus, the connector 495*x*. is dedicated to conveying microphone-related signals. Also within the interface 490*a*, the system-gnd, audio-left and audio-right conductors are coupled in a manner in accordance with the GA interface standard, and thus, the connector 495*y*. is dedicated to conveying signals related to at least one acoustic driver.

Figure 2B:
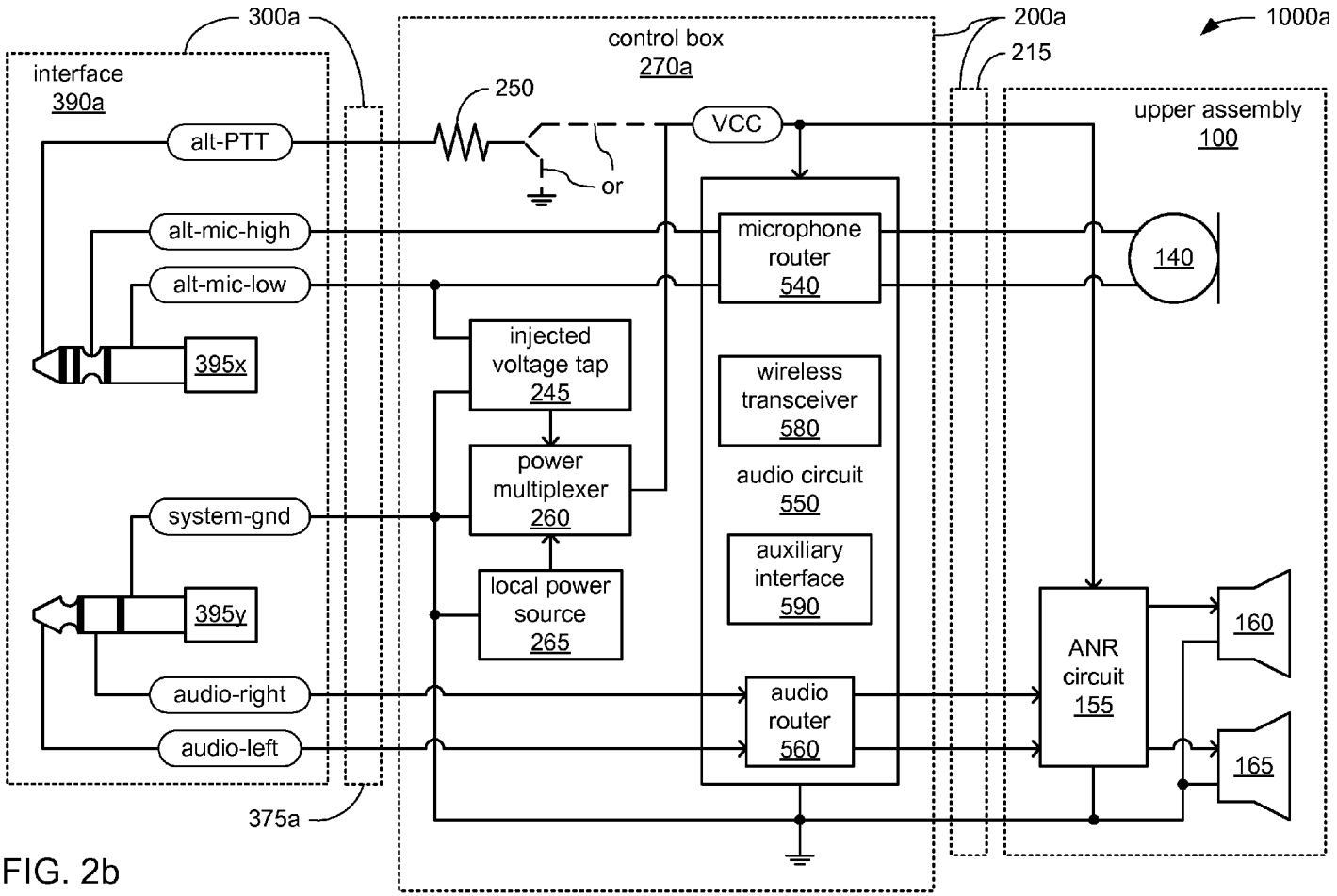

Turning to FIG. 2*b*, the connectors 395*x*. and 395*y*. of the interface 390*a*. are also selected to enable implementation of a GA-compliant headset interface such that they are selected to be able to be mate with the connectors 495*x*. and 495*y*, respectively, of the interface 490*a*. Therefore, preferably, the connector 395*x*. is a 0.206" TRS-type plug and the connector 395*y*. is a 0.250" TRS-type plug, in keeping with the GA interface standard. With the connectors 395*x*. and 395*y*. coupled to the connectors 495*x*. and 495*y*, respectively, the conductors alt-PTT, alt-mic-high, alt-mic-low, system-gnd, audio-left and audio-right are conveyed from the power injector 470*a*, through the interfaces 490*a*. and 390*a*, through the rest of the lower assembly 300*a*, and to the control box 270*a*.

The control box 270*a*. incorporates an injected voltage tap 245, a resistor 250, a power multiplexer 260, a local power source 265, and perhaps also an audio circuit 550 incorporating a microphone router 540, an audio router 560, and one or both of a wireless transceiver 580 and an auxiliary interface 590. The upper assembly incorporates the microphone 140, the acoustic drivers 160 and 165, and perhaps also an ANR circuit 155 and/or a pair of audio amplifiers (not shown). As has been depicted and discussed, it is envisioned that the control box 270*a*. and the upper assembly 100 are physically separate components coupled via the cable 215. Although depicted as separate, as has been previously mentioned, embodiments are possible in which the control box 270*a*. and the upper assembly 100 are combined as a single one-piece unit without the intervening cable 215.

Within the control box 270*a*, the system-gnd conductor is coupled to each of the injected voltage tap 245, the power multiplexer 260, the local power source 265, and one or more of what is incorporated into the audio circuit 550. The system-gnd conductor is also conveyed from the control box 270 to the upper assembly 100 via the cable 215 where it is also coupled to at least the acoustic drivers 160 and 165, as well as possibly also the ANR circuit 155 and/or a pair of audio amplifiers. The audio-left and audio-right conductors are coupled to the audio router 560 within the audio circuit 550, and through the audio router 560, the audio-left and audio-right conductors are selectively coupled to the acoustic drivers 160 and 165, perhaps also through the ANR circuit 155 and/or a pair of audio amplifiers. The alt-mic-low and alt-mic-high conductors are coupled to the microphone router 540 within the audio circuit 550, and through the microphone router 540, the alt-mic-low and alt-mic-high conductors are selectively coupled to the microphone 140. The alt-mic-low conductor is also coupled within the control box 270*a*. to the injected voltage tap 245. The alt-PTT conductor is coupled within the control box 270*a*. to the resistor 250.

The auxiliary interface 590, if present, incorporates at least a connector by which the cable 915 may be coupled to the control box 270*a*. to enable the formation of an electrical connection between the wired device 900 and the headset 1000*a*. to at least enable the conveyance of electrical signals therebetween that represent at least audio to be acoustically output by the acoustic drivers 160 and 165, if not also electrical signals representing sound detected by the microphone 140. The wireless transceiver 580, if present, enables the wireless device 800 and the headset 1000*a*. to exchange wireless signals across a wireless link 815 (referring back to FIG. 1) formed therebetween, wherein those wireless signals represent at least audio to be acoustically output by the acoustic drivers 160 and 165, if not also electrical signals representing sound detected by the microphone 140. In various embodiments, the wireless link 815 may be based on radio frequency (RF) signals, and may possibly be meant to comply with one or more widely known and used industry standards for RF communication including, and not limited to, the Bluetooth specification promulgated by the Bluetooth SIG based in Bellevue, Washington, or the ZigBee specification promulgated by the ZigBee Alliance based in San Ramon, Calif.

With either or both of the auxiliary interface 590 or the wireless transceiver 580 present, the microphone 140 and/or the acoustic drivers 160 and 165 must be shared in their use between two-way communications with the ICS 700 and either one-way or two-way communications with one or both of the wired device 900 and the wireless device 800. The microphone router 540 and/or the audio router 560 implement any of a variety of possible audio combining and/or audio distributing functions, possibly automated and/or possibly under a user's control via manually-operable controls carried by the control box 270*a*, to convey audio between components of the headset 1000*a*. More specifically, where audio to be acoustically output is received through either the auxiliary interface 590 or the wireless transceiver 580, that audio is conveyed to the audio router 560, which combines that audio with audio received from the ICS 700 that is also be acoustically output, and the combined audio is conveyed onward to the acoustic drivers 160 and 165. Similarly, where speech sounds detected by the microphone 140 are to be conveyed to one or more of the ICS 700, the wireless device 800 and the wired device 900, the microphone router 540 distributes those speech sounds to one or more of these as appropriate, either automatically or under the control of a user.

The ANR circuit 155, if present, employs any of a variety of forms of ANR to reduce the level of environmental acoustic noise in the vicinity of a user's ears, thereby enabling that user to more easily hear whatever audio they may wish to hear from the ICS 700, the wireless device 800 and/or the wired device 900. Alternatively or additionally, a pair of audio amplifiers may be incorporated into the headset 1000*a*, perhaps with either an automatic or manually-operable gain control, to enable a user to more easily hear whatever audio they may wish to hear.

The provision of one or more of such functions as may be provided by the headset 1000*a* beyond aircraft communications through the ICS 700, such as wireless communications with the wireless device 800, wired communications with the wired device 900, ANR, combining of audio, distribution of audio, and audio amplification of what is acoustically output by the acoustic drivers 160 and 165 require electric power. The power multiplexer 260 provides an output of such electric power onto a VCC conductor that couples the power multiplexer 260 to whichever one(s) of the audio circuit 550, the ANR circuit 155 or a pair of audio amplifiers (not shown) is present. The power multiplexer 260 is coupled to and able to receive electric power from each of the injected voltage tap 245 and the local power source 260. Being coupled to both the alt-mic-low and system-gnd conductors, if a DC voltage differential is being created between these two conductors by the injection voltage source 445 of the power injector 470*a*, the injected voltage tap 245 is a circuit that receives and conveys this electric power to the power multiplexer 260. Otherwise, if no such DC voltage differential is being created such that the injected voltage tap 245 is unable to convey electric power to the power multiplexer 260, then the power multiplexer 260 switches to drawing electric power from the local power source 265. It is envisioned that the local power source 265 is one of a variety of possible types of battery or other relatively large capacity device able to store a useable electric charge (perhaps a capacitor of relatively large charge capacity).

Given that pilots are envisioned to be among the users of the headset 1000*a*, it is preferable that the headset 1000*a*. have different power modes of operation that include at least one power mode in which a lack of electric power being provided either through the lower assembly 300*a* (e.g., electric power from the power injector 470*a*) or by the local power source 265 is responded to in a "failsafe" manner in which a pilot will still be able to use the headset 1000*a*. to communicate through the ICS 700 despite the lack of available electric power for the headset 1000*a*. Thus, it is preferred that in this one power mode, the microphone router 540 defaults to conveying the alt-mic-high and alt-mic-low conductors all the way between the connector 395*x*. and the microphone 140 to enable full microphone functionality; and that the audio router 560, the ANR circuit 155 and/or any audio amplifiers along the path between the connector 395*y*. and the acoustic drivers 160 and 165 default to conveying the audio-left and audio-right conductors all the way between the connector 395*y*. and the acoustic drivers 160 and 165 to enable full audio acoustic output functionality. In various embodiments, there may various other power modes by which different ones of the wireless transceiver 580, the ANR circuit 155 and/or other components of the headset 1000*a*. are selectively provided with electric power or not, depending on whether electric power is provided through the lower assembly 300*a*. (e.g., from the power injector 470*a*) or from the local power source 265, and/or possibly depending on how much electric power remains stored within the local power source 265.

As part of causing the injection voltage source 445 to create the DC voltage differential between the system-gnd and alt-mic-low conductors such that electric power is provided to the headset 1000*a*. through the lower assembly 300*a*, the resistor 250 is coupled to the system-gnd conductor to provide the triggering resistance to the PTT separator 450 via the alt-PTT conductor, as previously discussed. However, in an alternate embodiment, the resistor 250 may be coupled to the VCC conductor onto which the power multiplexer 260 outputs electric power and the PTT separator 450 may be configured to be triggered by the presence of a triggering voltage on the alt-PTT conductor, instead of a triggering resistance. It is preferred that the resistor 250 have a resistance high enough to avoid trigger the PTT function of an aircraft ICS where the power injector 470*a*. is not present (such that the PTT and alt-PTT conductors become one and the same), and yet also low enough to be distinguishable from the very high resistance consistent with their being nothing coupling the alt-PTT and alt-mic-low conductors.

Figure 3:
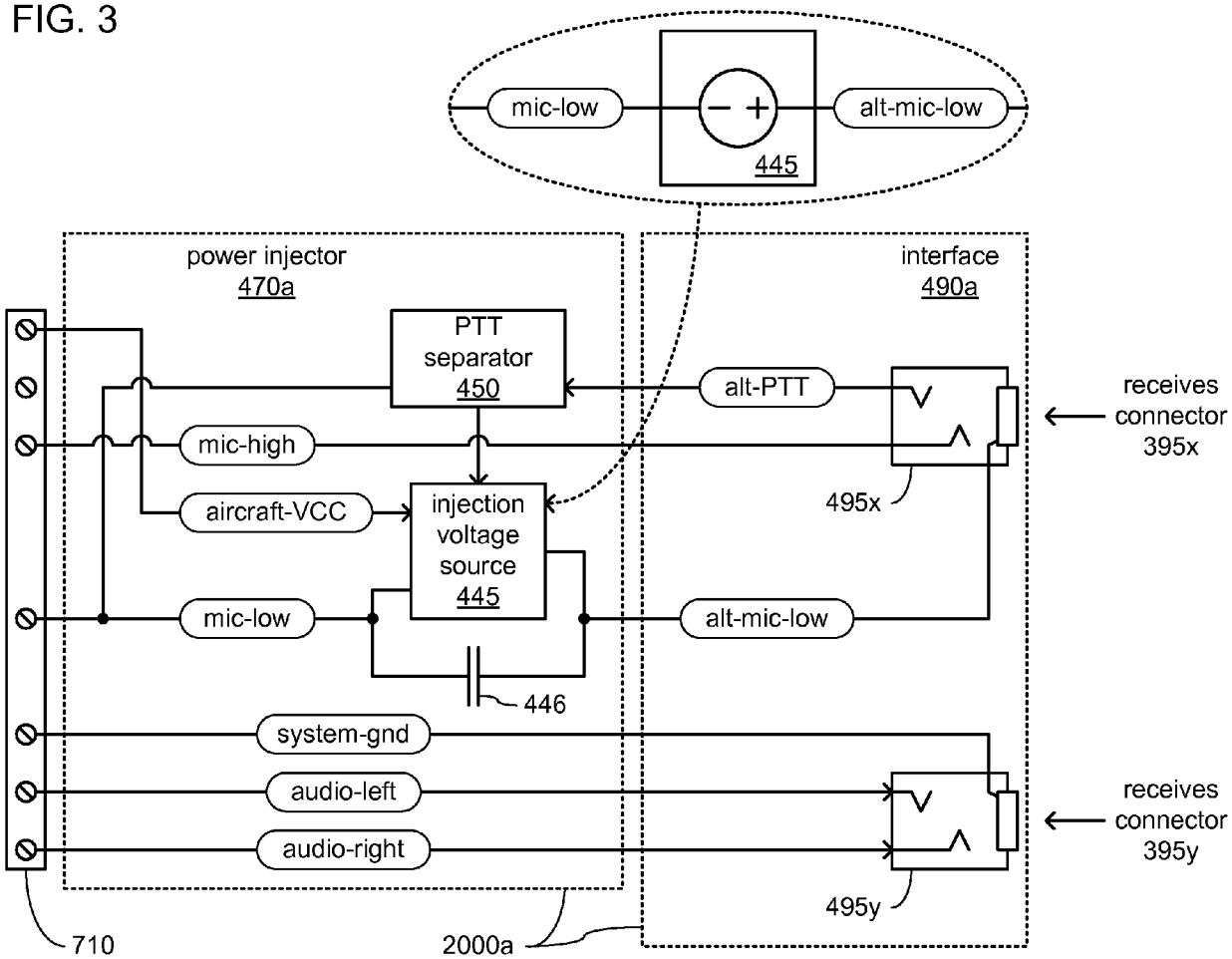
FIG. 3 is a block diagram of a portion of the block diagram of FIGS. 2*a-b*. depicting a modified form of circuitry enabling the provision of electric power to the headset of FIG. 1.

FIG. 3 depicts a variant of a portion of the electrical architecture depicted in FIGS. 2*a* and 2*b*, in which the electrical architecture within the power injector 470*a*. is altered to be simplified so as to eliminate the alternate bias voltage source 440 and its associated resistor 441 and capacitor 442, thereby allowing the mic-high conductor to pass through the power injector 470*a*. such that the mic-high and alt-mic-high conductors become one and the same conductor. This variant offering a somewhat simpler electrical architecture may be deemed desirable where the microphone bias voltage driven onto the mic-high conductor by the bias voltage source of the ICS 700 is deemed to be more than sufficiently large enough to support a microphone despite the manner in which operation of the injection voltage source 445 affects that microphone bias voltage from the perspective of a microphone coupled across the mic-high and alt-mic-low conductors. As those familiar with the operation of current-day electret microphones will readily recognize, the provision of 8-16VDC originally required for the support of carbon microphones is vastly more in the way of a bias voltage than is actually needed by current-day electret microphones, and current-day dynamic microphones do not require a bias voltage, at all. Thus, operation of the injection voltage source 445 in a manner that causes a shift of the alt-mic-low conductor by 3V such that the bias voltage provided to a microphone is reduced by 3V is unlikely to degrade or impair the function of current-day microphones (e.g., the microphone 140). As also depicted, there is no PTT conductor within this simpler variant of the power injector 470*a*. Through an inset, FIG. 3 also provides a depiction of the behavior of the injection voltage source 445 when enabled. As previously described in reference to FIG. 2*a*, when enabled, the injection voltage source 445 behaves very much like a voltage source placed across the mic-low and alt-mic-low conductors, and when not enabled, the injection voltage source 445 behaves like a short between those two conductors at lower frequencies.

Figure 4:
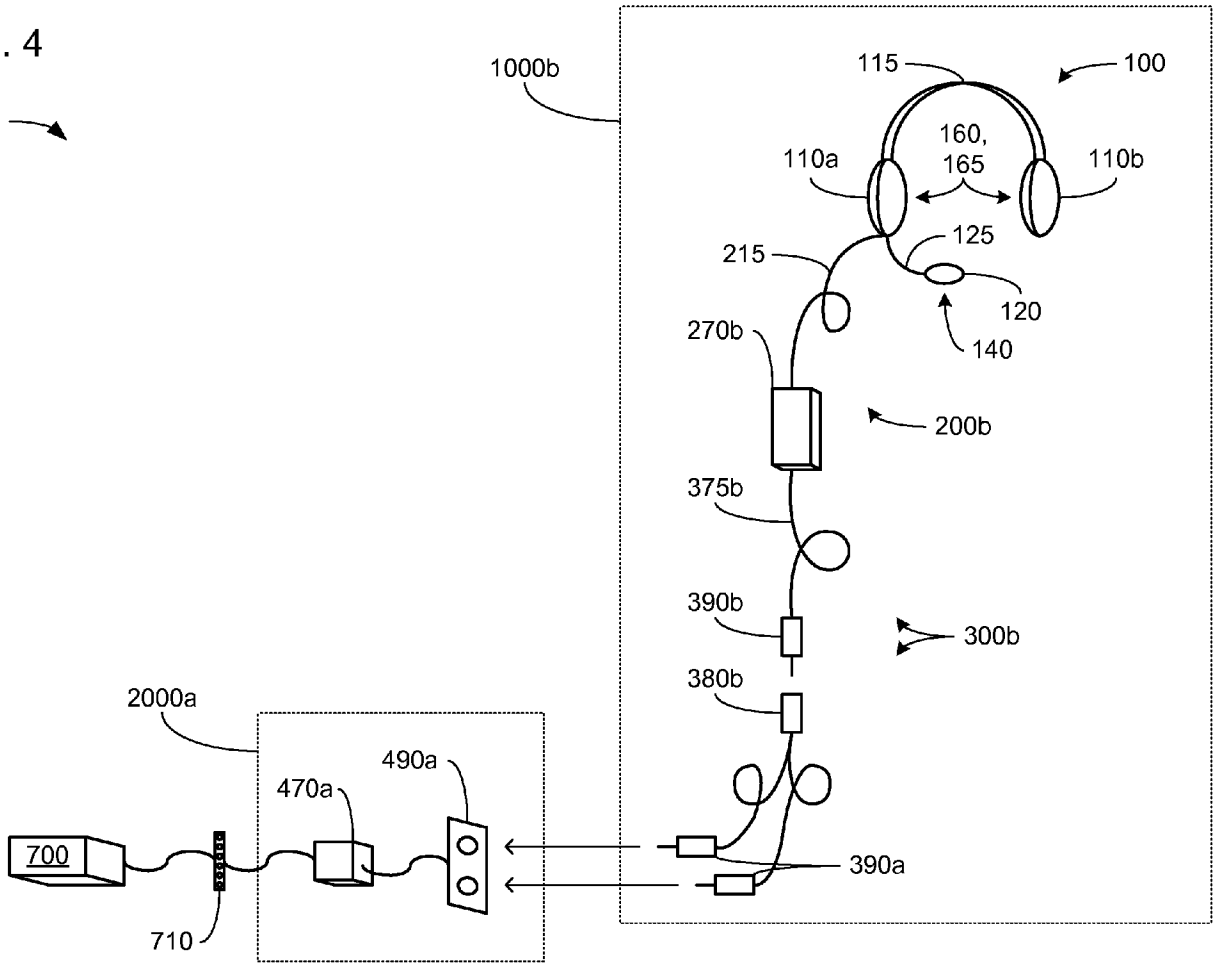
FIG. 4 is a perspective diagram of the communications system of FIG. 1 with a modified form of the headset.

FIG. 4 provides a perspective view of an alternate variant of the communication system 5000 incorporating an alternate headset 1000*b*. and the power injection assembly 2000*a*. The headset 1000*b*, like the headset 1000*a*, is capable of accepting the provision of electric power by way of shifting the voltage level of one of the conductors relative to another to create a voltage differential. However, a significant difference between the headsets 1000*a*. and 1000*b*, is that the lower assembly 300*b*. of the headset 1000*b*. is separable into two parts to enable the headset 1000*b*. to be used with other intercom systems having an interface other than the GA interface standard (e.g., the Lemo or a U-174. interface standard—in other words, the lower assembly 300*b*. includes an adapting cable). More specifically, the cable 375*a*. of the lower assembly 300*a*. has been replaced with a cable 375*b* coupled to a headphone interface 375*b*. made up of a single connector. Also part of the lower assembly 300*b*. is an adapting cable having the two connectors of the interface 390*a*. and a single connector selected to be able to mate with the connector of the interface 390*b*.

Figure 5A:
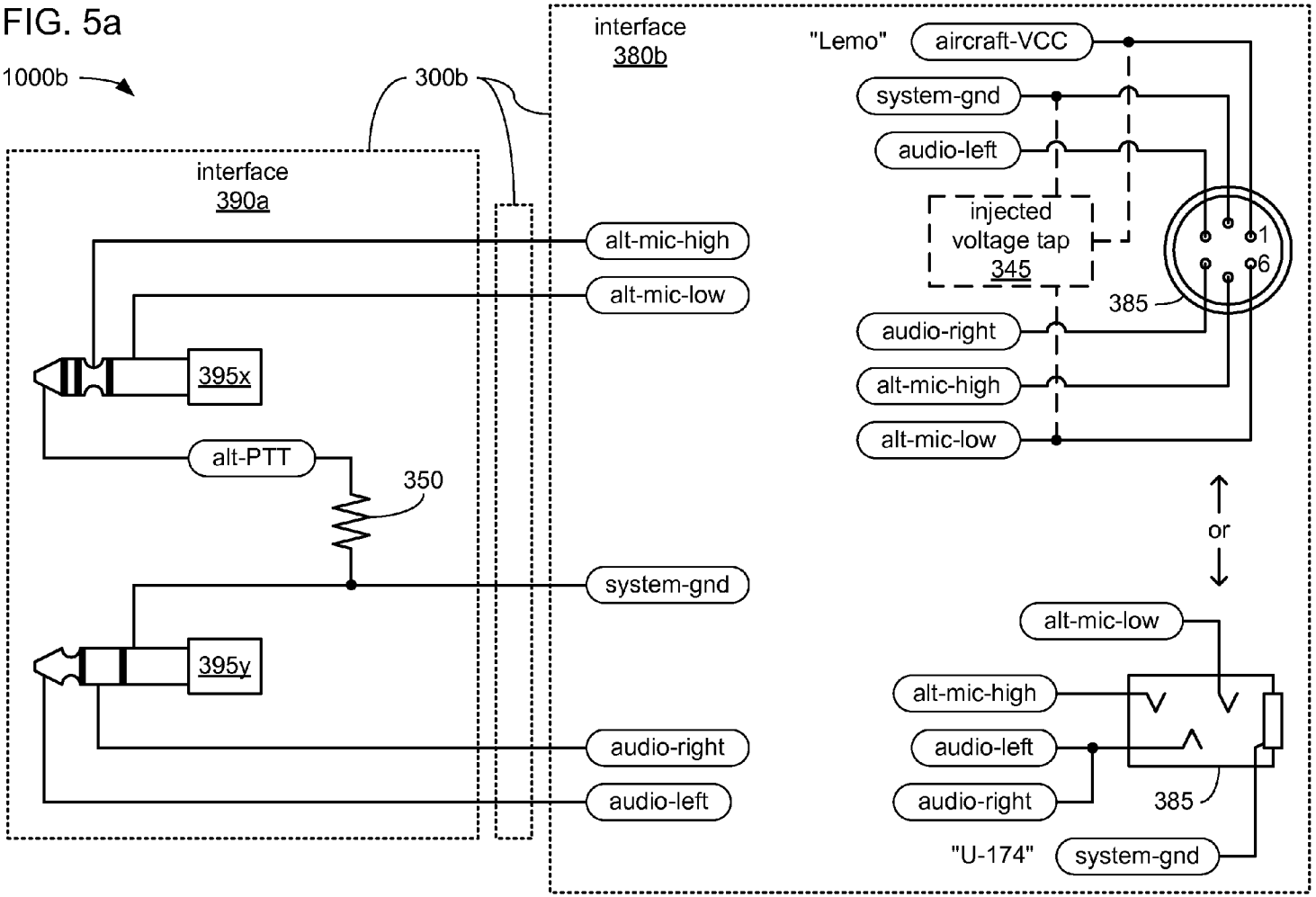
FIGS. 5*a*. and 5*b*, together, form a block diagram of a portion of a possible electrical architecture of the variant of communications system of FIG. 4, depicting possible use of alternate headset interfaces by the variant of headset of FIG. 4 and the provision of a detachable adaptive portion of cabling of that headset to accommodate those alternate interfaces.

FIGS. 5*a*. and 5*b*, together, depict portions of the electrical architecture in the headset 1000*b*. that differ from the possible electrical architecture depicted for the headset 1000*a*. in FIGS. 2*a-b*. Specifically, much of what is depicted centers on the interfaces 380*b*. and 390*b*. where the lower assembly 300*b*. is separable into two parts through the use of connectors compliant to an interface standard other than the GA interface standard, such as either the Lemo or U-174. interface standard.

As those skilled in the art of aircraft communications systems will readily recognize, and as can be clearly seen, neither of the Lemo or U-174. interface standard support the provision of any form of PTT conductor. Therefore, to provide the triggering resistance needed to cause the PTT separator 450 of the power injector 470*a*. (referring back to either FIG. 2*a*. or FIG. 3) to enable the operation of at least the injection voltage source 445 (and possibly also operation of the alternate bias voltage source 440) to cause provision of electrical power as previously described, a resistor 350 is incorporated into one or the other of a variant of the interface 390*a*. (as depicted) or the interface 380 to couple the alt-PTT conductor to the system-gnd conductor. In other words, it is not possible to convey the alt-PTT conductor throughout the length of the lower assembly 300*b*, and thus, the function of the resistor 250 in the control box 270*a*. (referring back to FIG. 2*b*) of the headset 1000*a* is performed by the resistor 350, instead. With the resistor 250 having been made redundant, the headset 1000*b*. also differs from the headset 1000*a*. in that the headset 1000*b*. incorporates an alternate control box 270*b*. that differs from the control box 270*a*. at least to the extent that the control box 270*b* does not incorporate the resistor 250.

Figure 5B:
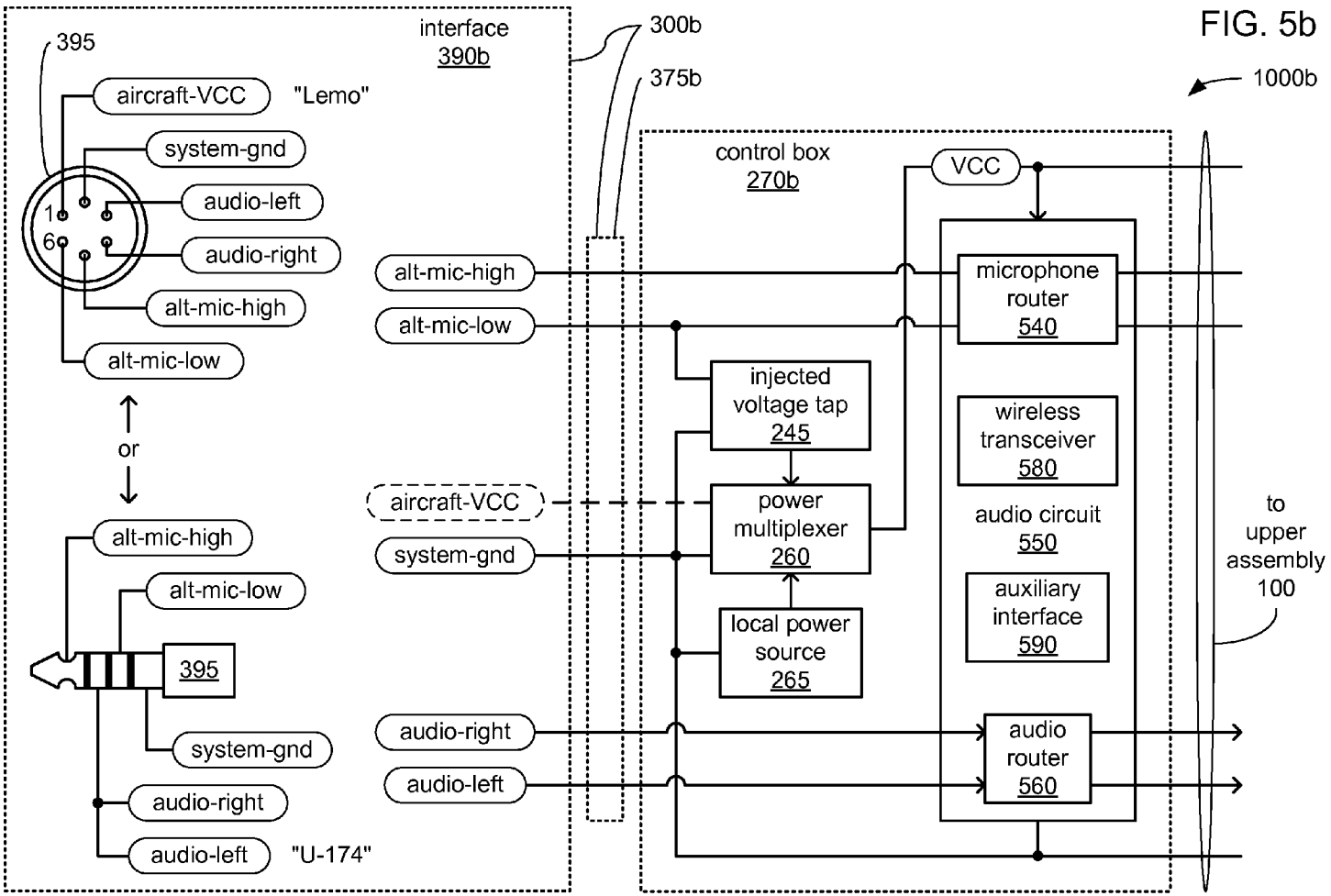

However, where the interfaces 380*b*. and 390*b*. are made to conform to the Lemo interface standard, then as depicted in FIG. 5*b*, the control box 270*b*. may also differ from the control box 270*a*. inasmuch as the power multiplexer 260 may be capable of accepting and employing the aircraft-VCC to provide electric power on the VCC conductor, in addition to being capable of accepting and employing electric power from either of the injected voltage tap 245 or the local power source 265. Thus, where the headset 1000*b*. is coupled via the interface 380*b*. to another aircraft ICS providing a Lemo-compliant interface such that a conductor providing an aircraft-VCC is available, the power multiplexer 260 detects the provision of that aircraft-VCC and employs it in providing VCC to other components of the headset 1000*b*, thereby avoiding draining the local power source 265. However, where the headset 1000*b*. is coupled via the interface 390*a*. to the ICS 700 through the power injection assembly 2000*a*. (and where the two parts of the lower assembly 300*b*. are coupled via the interfaces 380*b*. and 390*b*), the resistor 350 acts to trigger the provision of electric power by at least the injection voltage source 445, the injected voltage tap 245 detects and receives that electric power, and the power multiplexer 260 employs it in providing VCC to other components of the headset 1000*b*, thereby again avoiding draining the local power source 265. Of course, where their is no distinct conductor conveying aircraft-VCC and there is no shifting of alt-mic-low conductor to create a voltage differential to provide electric power (in other words, where no electric power is provided via the lower assembly 300*b*), the power multiplexer reverts to drawing electric power from the local power source 265.

Where the interface 380*b*. conforms to the Lemo interface standard, FIG. 5*a*. further depicts the optional incorporation of an injected voltage tap 345 coupled to the alt-mic-low and system-gnd conductors to receive electric power where a voltage differential is created between those to conductors, and coupled to the aircraft-VCC conductor to output electric power onto that conductor. Given that as depicted in FIG. 5*b*, the headset 1000*b*. already incorporates the injected voltage tap 245 to draw power from a voltage differential between the alt-mic-low and system-gnd conductors, the incorporation of the injected voltage tap 345 may be deemed unnecessary for the headset 1000*b*. However, incorporation of the injected voltage tap 345 may be deemed desirable where it is believed there is a likelihood of the portion of the lower assembly 300*b*. having the interfaces 390*a*. and 390*b*. being employed as an adapting cable between the power injection assembly

2000*a*. and a headset other than the headset 1000*b*. that has a headset interface made to conform to the Lemo interface standard and which is unable to make use of electric power provided as a voltage differential between the alt-mic-low and system-gnd conductors. The incorporation of the injected voltage tap 345 would enable that other headset to be provided with electric power in a manner that is far more conventional with a Lemo-compliant interface, namely via its aircraft-VCC conductor.

Figure 6:
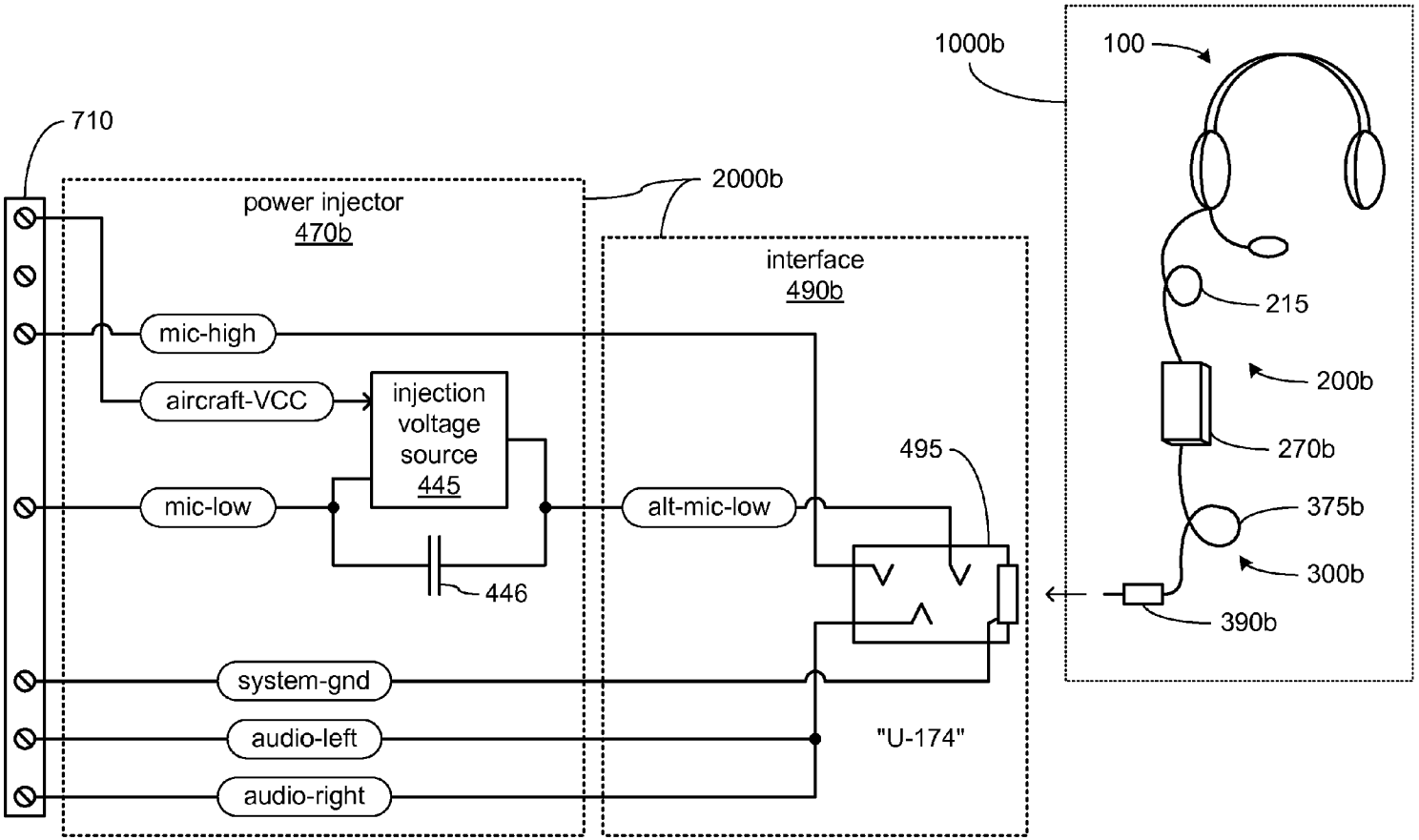
FIG. 6 is a block diagram of a portion of a possible electrical architecture of the variant of communications system of FIG. 4, depicting a modified form of power injector assembly.

FIG. 6 depicts an electrical architecture of an alternate power injector 470*b*. that differs from the variant of the power injector 470*a*. depicted in FIG. 3 inasmuch as the power injector 470*b* does not incorporate the PTT separator 450 such that the injection voltage source 445 is always enabled as long as aircraft-VCC voltage is provided. The power injector 470*b*. is coupled to an alternate headset interface 490*b*. incorporating a single connector 495 compliant with the U-174 interface standard, instead of the pair of connectors 495*x*. and 495*y*. The U-174. interface standard, like the GA interface standard, incorporates no support for a distinct conductor to convey electric power, and the power injection assembly 2000*b*. made up of the power injector 470*b*. and the headset interface 490*b*. address this such that the headset 1000*b*. may be provided with electric power.

Figure 7:
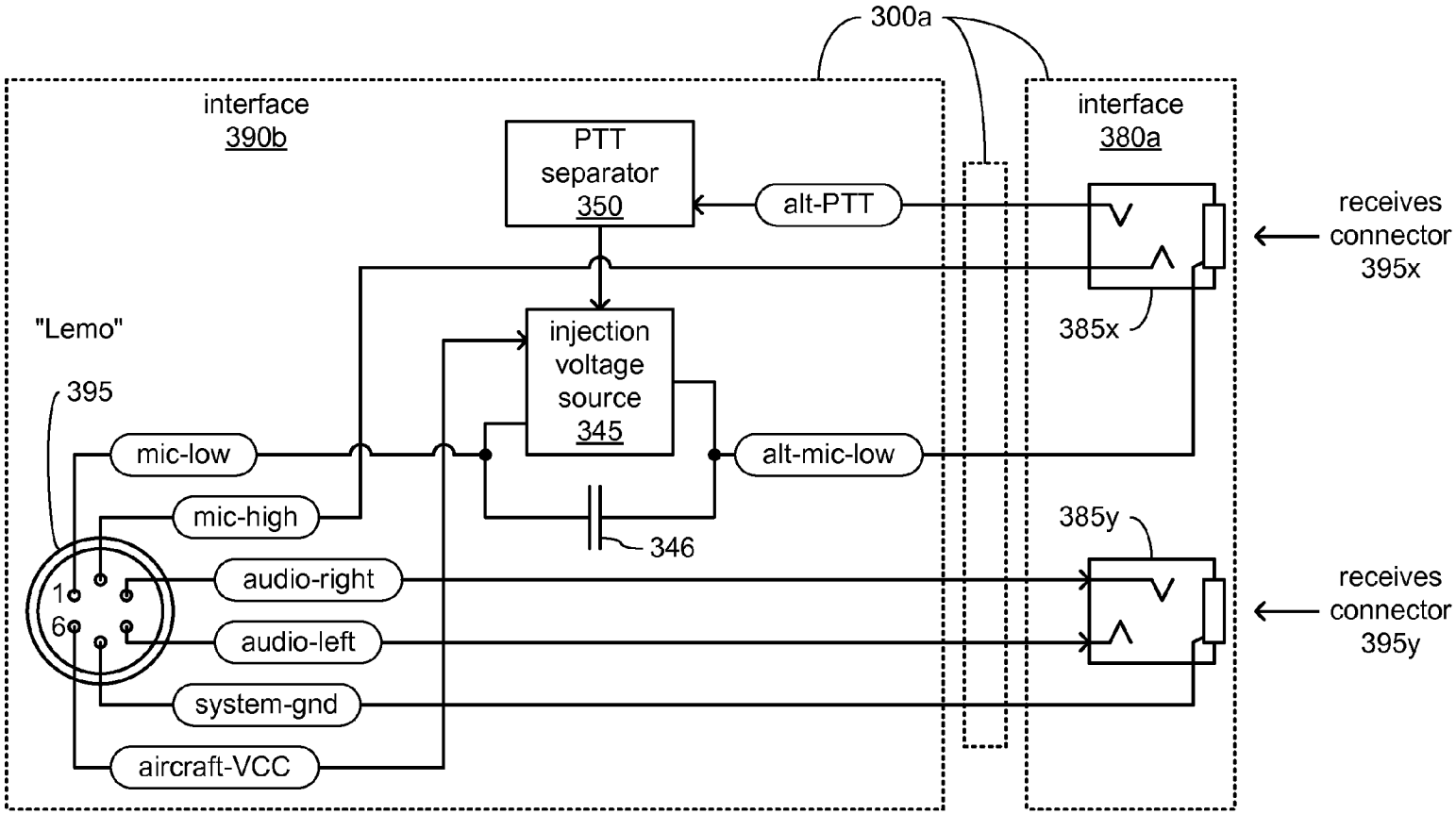
FIG. 7 if a block diagram of a possible electrical architecture of an additional portion of the headset of FIG. 1.

FIG. 7 depicts an electrical architecture for a possible additional portion of the lower assembly 300*a*. that was not depicted in FIG. 1. This additional portion incorporates the headset interface 390*b*. with a Lemo-compliant form of the connector 395, and a headset interface 380*a*. with GA-compliant connectors 385*x*. and 385*y*. meant to be mated with the connectors 395*x*. and 395*y*, respectively, of the rest of the lower assembly 300*a*. (in other words, this additional portion is an adapting cable). The mic-high, audio-left, audio-right and system-VCC conductors are coupled between the connector 395 and the connectors 385*x*. and 385*y*. However, in a manner somewhat akin to the simpler variant of the power injector 470*a*. of FIG. 3, the mic-low conductor is coupled to the alt-mic-low conductor through a capacitor 346 and an injection voltage source 345 that is selectively enabled by a PTT separator 350, and an aircraft-VCC is provided to the injection voltage source 345. This additional portion enables the headset 1000*a*. to be coupled to an aircraft ICS with only a Lemo-compliant headset interface.

It should be noted that although the components for "injecting" electric power by creating a DC voltage differential in the manner that has been described have been depicted as being incorporated into either a distinct power injector (e.g., the power injectors 470*a*. and 470*b*) or an adapting cable (e.g., the adapting cables of FIGS. 4 and 7 that are part of the cable assemblies 300*b* and 300*a*, respectively), other embodiments are envisioned as possible in which an ICS may itself incorporate such components so as to be able to generate such a DC voltage differential.

Other embodiments and implementations are within the scope of the following claims and other claims to which the applicant may be entitled.

The invention claimed is:

1. A power injection circuit to provide electric power to an aviation headset, the power injection circuit comprising:

an aircraft intercom system (ICS) interface for connection to an ICS, the ICS interface including at least a voltage (VCC) connection, a microphone high (mic-high) connection, a microphone low (mic-low) connection, and a system ground (system-gnd) connection;

a headset interface comprising at least one connector to receive at least one connector of the headset;

an alternate microphone low (alt-mic-low) conductor coupled to the headset interface to conduct a signal of a microphone of the headset;

a system ground conductor coupled to the ICS interface and the headset interface to couple a headset ground to the system ground connection;

a first voltage source coupled to the alt-mic-low conductor to create a DC voltage differential between the alt-mic-low conductor and the system ground conductor;

an alternate push-to-talk (alt-PTT) conductor coupled to the headset interface; and a PTT separator coupled to the alt-PTT conductor to monitor the PTT conductor, and to signal the first voltage source to enable the first voltage source in response to detecting a triggering resistance between the alt-PTT conductor and the alt-mic-low conductor.

2. The power injection circuit of claim 1, wherein:

the headset interface comprises a first connector and a second connector to receive two connectors of the headset;

the alt-mic-low conductor is coupled to the first connector; and the system ground conductor is coupled to the second connector.

3. The power injection circuit of claim 1, further comprising:

an alternate microphone high (alt-mic-high) conductor coupled to the interface to cooperate with the alt-mic-low conductor to conduct the signal of the headset;

a second voltage source; and a resistor coupling the second voltage source to the alt-mic-high conductor to provide an alternate microphone bias voltage between the alt-mic-high conductor and the system ground conductor, wherein the alternate microphone bias voltage differs from an expected microphone bias voltage by a voltage similar to the DC voltage differential between the mic-low connection and the system ground connection.

4. The power injection circuit of claim 1 wherein:

the ICS interface further includes a PTT connection, and the PTT separator couples the PTT connection to the mic-low connection with low resistance when it detects a low resistance between the alt-PTT connection and the alt-mic-low conductor.

5. The power injection circuit of claim 1 further comprising:

a DC-blocking capacitor coupling the mic-low connection to the alt-mic-low conductor in parallel with the injection voltage source, to pass voice-band signals from the alt-mic-low conductor to the mic-low connection, while blocking the DC voltage from reaching the mic-low connection.

6. The power injection circuit of claim 1 further comprising:

an alternate microphone high (alt-mic-low) conductor coupled to the headset interface to conduct the signal of a microphone of the headset; and an alternate bias voltage source powered by the VCC connection and providing a first DC voltage on the alt-mic-high conductor relative to the mic-low connection.

7. The power injection circuit of claim 6 further comprising:

a DC-blocking capacitor coupling the mic-high connection to the alt-mic-high conductor, to pass voice-band signals from the alt-mic-high conductor to the mic-high connection, while blocking the first DC voltage from reaching the mic-high connection.

8. A system for powering active electronics within an aviation headset, the system comprising:

a power injection circuit comprising:

an aircraft intercom system (ICS) interface for connection to an ICS, the ICS interface including at least a voltage (VCC) connection, a microphone-high (mic-high) connection, a microphone-low (mic-low) connection, and a system ground (system-gnd) connection;

a first headset connection interface including at least one connector to receive at least one connector of the headset;

an alternate mic-low (alt-mic-low) conductor and an alternate push-to-talk (alt-PTT) conductor, each coupled to the first headset interface;

a system ground conductor coupled to the ICS interface and the first headset interface to couple a headset ground to the system ground connection;

an injection voltage source powered by the VCC connection and providing a DC voltage on the alt-mic-low conductor relative to the system ground conductor; and a PTT separator coupled to the alt-PTT conductor to monitor the alt-PTT conductor, and to signal the injection voltage source to enable the injection voltage source in response to detecting a triggering resistance between the alt-PTT conductor and the alt-mic-low conductor; and a headset power supply comprising:

a second headset connection interface for mating with the first headset connection interface and including at least a headset alt-mic-low connection, a headset alt-PTT connection, and a headset ground connection coupled to the headset ground;

an injected voltage tap circuit extracting the DC voltage between the headset alt-mic-low connection and the headset ground connection and providing the DC voltage to the active electronics within the headset as a power supply voltage; and a triggering resistor connecting the headset alt-PTT connection to the headset alt-mic-low connection.

9. The system of claim 8 wherein the power injection circuit further comprises:

a DC-blocking capacitor coupling the mic-low connection to the alt-mic-low conductor in parallel with the injection voltage source, to pass voice-band signals from the alt-mic-low conductor to the mic-low connection, while blocking the DC voltage from reaching the mic-low connection.

10. The system of claim 8 wherein the power injection circuit further comprises:

an alternate microphone high (alt-mic-low) conductor coupled to the headset interface to conduct the signal of a microphone of the headset; and an alternate bias voltage source powered by the VCC connection and providing a second DC voltage on the alt-mic-high conductor relative to the mic-low connection.

11. The system of claim 10 wherein the power injection circuit further comprises:

a DC-blocking capacitor coupling the mic-high connection to the alt-mic-high conductor, to pass voice-band signals from the alt-mic-high conductor to the mic-high connection, while blocking the second DC voltage from reaching the mic-high connection.

12. The system of claim 10 wherein:

the second headset connection interface includes a headset alt-mic-high connection; and a third DC voltage existing between the headset alt-mic-high connection and the headset alt-mic-low connection is available to the microphone of the headset as a microphone bias voltage, the third DC voltage comprising the difference between the second DC voltage and the DC voltage from the injection voltage source.

13. An aviation headset for use with a power injection circuit, the headset comprising:

a headset interface by which the headset may be coupled to a matching headset interface of the power injection circuit, the headset interface including at least a microphone-high (mic-high) connection, a microphone-low (mic-low) connection, a push-to-talk (PTT) connection, and a ground connection;

an acoustic driver to acoustically output audio to an ear of a user;

an acoustic driver ground conductor coupling the acoustic driver to the ground connection of the headset interface;

a microphone to detect speech sounds of the user;

a microphone low signal conductor and a microphone high signal conductor coupling the microphone to the mic-low and mic-high connections, respectively, of the headset interface; and an injected voltage tap circuit coupled to the ground connection and to the mic-low connection to receive electric power from a DC voltage differential between the ground connection and the mic-low connection provided by the power injection circuit; and a triggering resistor connecting the PTT connection to the mic-low connection of the headset interface.

14. The headset of claim 13, wherein the headset enters a failsafe mode in which the microphone and the acoustic driver continue to be useable with an ICS coupled to the headset interface in response to there being no DC voltage differential between the mic-low connection and the ground connection.

* * * * *